United States Patent [19]

Strang et al.

[11] Patent Number: 5,057,831

[45] Date of Patent: Oct. 15, 1991

[54] VEHICLE SIMULATION CIRCUIT FOR LOOP TRAFFIC SIGNAL CONTROL SYSTEM

[75] Inventors: Clifford B. Strang, Rockford, Ill.; John R. Frus, Jacksonville, Fla.

[73] Assignee: Signalmatic International, Inc., Stillman Valley, Ill.

[21] Appl. No.: 529,881

[22] Filed: May 29, 1990

[51] Int. Cl.[5] ..... G08G 1/01

[52] U.S. Cl. ..... 340/941; 340/933; 340/515

[58] Field of Search ..... 340/941, 933, 934, 935, 340/907, 908, 917, 870.31, 870.32, 551, 552, 561, 572, 515; 324/207.15, 207.22, 260

[56] References Cited

U.S. PATENT DOCUMENTS

| | | | |
|---|---|---|---|
| 3,859,624 | 1/1975 | Kriofsky et al. | 340/941 |
| 4,321,589 | 3/1982 | King | 340/941 |
| 4,529,982 | 7/1985 | Karlstrom et al. | 340/941 |
| 4,566,008 | 1/1986 | Powers et al. | 340/515 |
| 4,630,044 | 12/1986 | Polzer | 340/941 |
| 4,912,471 | 3/1990 | Tyburski et al. | 340/941 |

*Primary Examiner*—Donnie L. Crossland
*Attorney, Agent, or Firm*—M. Paul Hendrickson

[57] ABSTRACT

The present invention provides a simulator which when used aboard a vehicle normally undetectable by a traffic signal control system (e.g. A.C. energized buried sensing loop type which detects predetermined changes in the characteristics of an electromagnetic field due to the presence of a detectable vehicle therewithin), will substantially simulate the characteristics of a detectable vehicle within its field and thereby cause any activation of the system. Operationally, the simulator derives an electrical signal from the field (e.g. via a receiving antenna), converts the electrical signal into a modified transmittable signal of an amplitude which when impressed upon the field (e.g. via a transmitting antenna) simulates electromagnetic influence of a detectable vehicle therewithin which is sensed by the detector circuitry and activates an associated traffic signal controller to provide the necessary signals (e.g. a green arrow) to allow safe and unobstructed traffic flow at an intersection.

28 Claims, 3 Drawing Sheets

VEHICLE SIMULATION CIRCUIT FOR LOOP TRAFFIC SIGNAL CONTROL SYSTEM

FIELD OF THE INVENTION

Generally, this invention relates to vehicular traffic control, and more particularly to traffic control systems wherein a radio-frequency loop in or on a roadway detects that presence of vehicular traffic and alerts an associated traffic signal to accommodate such traffic.

More specifically, the present invention pertains to an electronic simulator for use by undetectable vehicles (e.g. of a small or insufficient metallic mass, a mass distribution outside its field of detection or otherwise undetectable thereby) which produces in such sensing loops operative changes substantially simulating those which would be created by the presence of a detectable vehicle. The simulator thus permits more efficient operation of these traffic signal systems when used in conjunction with such undetectable vehicles.

BACKGROUND OF THE INVENTION AND DESCRIPTION OF THE PRIOR ART

The prior art abounds with electrical and electronic traffic control systems and is replete with systems for controlling the operation of traffic signal lights in response to various stimuli, such as the reception of electromagnetic radiation (whether visible or invisible light or radio frequency energy, and coded or otherwise), the operation of a switch (such as a roadway treadle) to alert a control circuit, or, and as in the field of the present invention, the disturbance of an electromagnetic field associated with a sensing loop in the roadway.

One example of the use of such detector loops is in left turn lanes where an extra cycle in the traffic control sequence would be initiated upon detection to allow for left turning vehicles only if the detector senses the presence of a vehicle in that lane.

As specific examples of some of the known prior art, U.S. Pat. No. 2,981,878—Henderson, U.S. Pat. No. 2,881,409—Cook et al., and U.S. Pat. No. 2,203,871—Koch are illustrative of traffic signal control system which utilize a radio-frequency transmission from an emergency vehicle or the like as it approaches the signal, say, at an intersection to be cleared of cross traffic for safe passage of the controlling vehicle or vehicles.

Prior-art systems which interact with inductive-loop roadway sensors by means of a transmission of an electrical signal from the adjacent vehicle to the sensor loop are exemplified by U.S.Pat. No. 4,731,867—Seabury et al. and U.S. Pat. No. 3,839,717—Paul, but in each instance such transmission is for the purpose of communication to what may be termed a third-party system instead of controlling the associated traffic signal, a control that is, in the systems of these patents, specifically precluded.

U.S. Pat. No. 4,472,706—Hodge et al., U.S. Pat. No. 4,529,982—Karlstom et al., U.S. Pat. No. 4,566,008—Powers et al., U.S. Pat. No. 3,693,144—Friedman and U.S. Pat. No. 4,430,636—Bruce are representative of the prior-art traffic signal control systems with which the simulator of the present invention is intended to cooperate. That is, these patents disclose loop roadway sensors the field of which normally responds to the presence of a major vehicle (one with a metallic mass and location above ground of at least a system-design minimum) to afford a green light or other safe passage condition for such vehicle.

At first glance the traffic detector and signal light control system of U.S. Pat. No. 4,321,589—King appears to bear a resemblance to the system of the present invention, since King radiates a signal from the approaching vehicle to a roadway detector for controlling the associated signal lights. However, this apparent similarity is purely superficial, since multiple roadway sensors are employed in King in sequence to respond to radiation at a frequency or frequencies reserved for emergency vehicles in a signal-control circuit of specific design for such a system. Thus, only emergency vehicles may operate the system of King, and no response is forthcoming therein upon the presence of customary, non-emergency vehicular traffic.

SUMMARY OF THE INVENTION

The present inVention affords a novel approach to the problems of traffic-signal control, being specifically addressed to ensure the detection of an otherwise undetectable vehicle to allow safe and unobstructed traffic flow. Motorcycles, motor scooters and other similar vehicles of an insufficient metallic mass (or no metallic mass such as vehicles of substantial non-metallic construction), high-wheeled vehicles and vehicular transports (e.g. such as semi-trailers), etc. by having aboard the simulator of the present invention, now have the means to substantially duplicate or replicate the simulated presence or influence of a detectable vehicle insofar as the roadway sensing loop and the associated control circuitry are able to determine.

This entirely novel and surprising result is obtained in accordance with the present invention by deriving a signal from the electromagnetic field of the sensing loop, amplifying it and impressing upon such field a re-radiated signal representative of such amplified signal in a phase which creates within the field of the loop a disturbance substantially simulating that which would occur upon the presence therein of a detectable vehicle within the system. The electromagnetic field of the sensing loop generally constitutes what may be termed a "mound" above the roadway, and the circuitry of the present invention may easily be operationally mounted (e.g. at an inconspicuous position such as on or under the low-mass vehicle) so as to intercept the field and interact therewith. The invention enhances safety at such traffic controlled intersections by ensuring that normally undetectable vehicles will be detected and the traffic control cycles will allow for their safe movement through traffic congestions at controlled intersections. Safety hazards created by the presence of such undetectable vehicles or conveyances within the traffic control detection zone are thereby effectively alleviated.

DETAILED DESCRIPTION OF A PREFERRED EMBODIMENT

Figure 1:
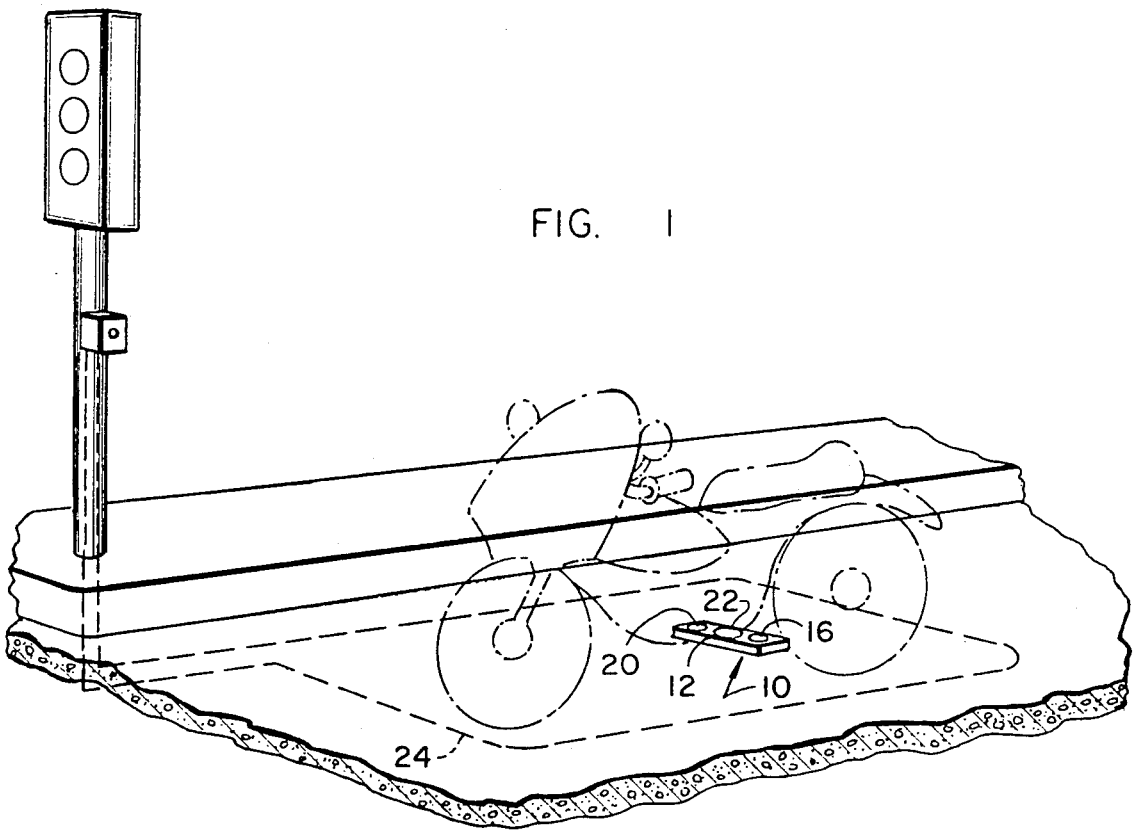
FIG. 1 is a perspective representation of a motorcycle, shown in shadow lines, with the mobile-vehicle simulator of the present invention mounted thereon for interaction with a roadway loop.

In accordance with one preferred embodiment of the present invention, the simulator unit 10 (e.g. see FIG. 1) comprises a unitary housing 12 including in one end 16 thereof a receiving antenna (also shown in FIG. 3 as 16 and also referenced herein as "R") and in the opposite end thereof a transmitting antenna 20 (shown in FIG. 3 as 20 and also referred to herein as "T"), and a circuit module 22 (containing the circuitry of FIG. 3), interconnecting the receiving antenna 16 to the transmitting antenna 20 and powered by a power lead from the motorcycle battery (not shown). The depicted motorcycle is further shown in FIG. 1 as being within the inductive field of sensing loop 24.

With reference to the Figures, the simulator unit 10 (as explained later in greater detail) provides an effective device for use aboard an otherwise undetectable vehicle in conjunction with a traffic signal control system for selectively governing the operation of an associated traffic signal of the type having an A.C. energized sensing loop 24 buried in or otherwise positioned relative to a roadway which under its typical mode of operation detects predetermined changes in the characteristics of an electromagnetic field created by the presence of a detectable vehicle, which in turn causes an activation of the traffic control system. The simulator of this invention when transported aboard an otherwise undetectable vehicle or conveyance impresses such predetermined changes and activation of the system. In general, the simulator 10 comprises:

a) means for deriving an electrical signal from said field (e.g. receiving antenna 16),
b) means for amplifying said electrical signal (circuit module 22) into an amplified signal,
c) means for impressing upon said field a representation of said amplified signal (e.g. transmitting antenna 20), whereby the activation by said simulator 10 aboard said undetectable Vehicle serves to modify the characteristics of said field in a manner substantially simulating that produced by a detectable vehicle.

As illustrated in greater detail later, one or more receiving antennas (R) may serve as a means for deriving the electrical signal from the field. Multiple receiving antennas (R) as explained later, represent an alternative design which under certain conditions may be used to advantage. Similarly, one or more transmitting antennas (T) (albeit one is normally sufficient) may serve as a means for impressing an amplified signal upon the field so as to substantially simulate the electromagnetic influences as produced by a detectable vehicle.

The electronic circuitry of the simulator 10 upon deriving the electrical signal from the field modifies the electrical signal into a transmittable signal which when impressed (e.g. transmitted) upon the field substantially simulates the activating effects or influence produced by a detectable vehicle. The signal modification includes its amplification into a form which when transmitted onto the field simulates that of a detectable vehicle passing within the field. The circuit module 22 (as described later) suitably includes means for filtering and reshaping the derived electrical signal into a reshaped wave form of a sufficient amplitude to cause activation of the system. This activation typically involves a frequency shift in the electrical signal eminated by the loop which is detectable by the loop system as simulating the influence of a detectable vehicle within its field of detection.

A unitary housing 12 (as depicted in FIG. 1), while not necessary, represents one method for ensuring that the mounting positions of antennas (16 and 20) are correctly aligned so as to insure constructive phasing of the interference patterns, thus preventing "lock up" problems as discussed hereinafter. Such a problem can arise if the transmitting 20 and receiving 16 antennas are improperly mounted and either of them has been flipped to an upside down position so as to cause a permanent phase reversal which creates a "lock up" of the loop detector system, or which fails to activate the system.

Figure 2:
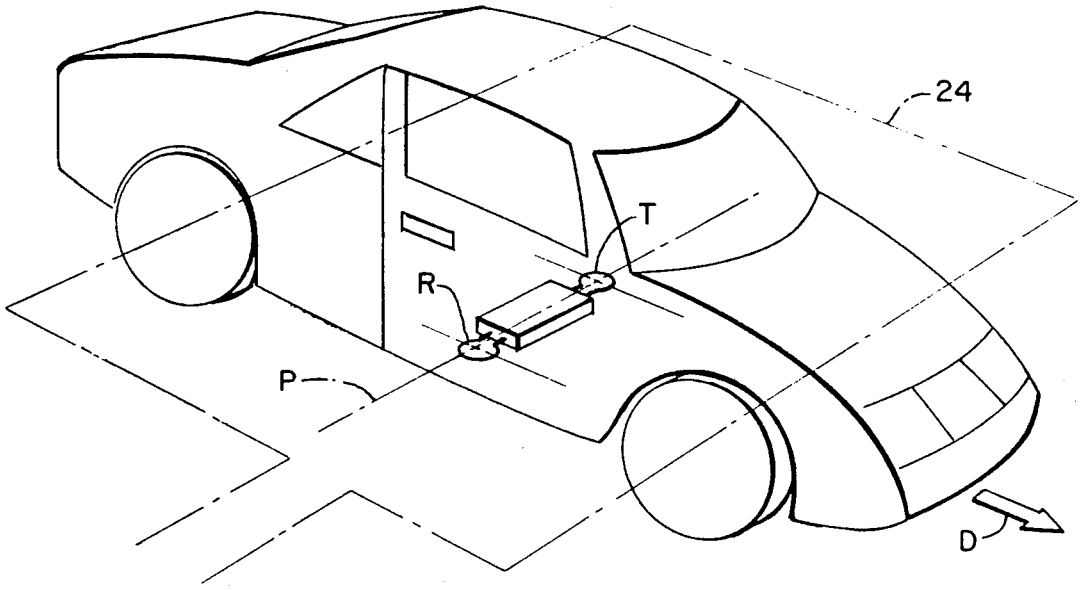
FIG. 2 is a perspective representation of the device of the invention with associated antenna as placed on an undetectable car and illustrates proper physical orientation relative to the roadway detector and to the direction of travel of the vehicle.

The intrinsic significance shown in FIGS. 1 and 2 is the teaching (in a preferred embodiment) that the elongated simulator unit 10 is placed in horizontal orientation (i.e. the plane of the T and R loops are parallel to and at the same height above the loop detector/roadway) and the line intersecting the centers of the T and R loops, (which is designated by line "P" in FIG. 2) is perpendicular to the line defining the direction of vehicular travel (depicted in FIG. 2 as arrow "D") at a fixed intercepting position (shown as low as is feasible) in a manner commensurate with the overall design considerations of the vehicle and the field. Such an arrangement enhances the interaction between both of the antennas (16 or R and 20 or T), and the inductive field of the roadway sensing loop 24. This will be more fully appreciated when viewed within the context of the FIG. 3 and 4 teachings herein. It may also be observed from FIG. 2 that the orientation (e.g. note P and D) of the Transmit (T)/Receive (R) antennas are such that they enter the loop substantially simultaneously so as to prevent a field reversal situation which results in "locking up" the loop detector.

The exact position of the wire loop 24 in the roadway constitutes an electrical boundary line directly above the buried wire. Directly above this boundary there is zero magnetic field perpendicular to the road surface. Inside or outside the boundary, the signals increase in magnitude, but are of opposite phase on opposite sides of the boundary. The signals picked up by a R antenna just inside the loop will be 180 degrees out of phase (opposite polarity) compared to the signal picked up by a R antenna just outside the loop. A T/R antenna system both inside the loop will cause a constructive modification of the field. A T/R antenna system placed both outside the loop will also cause a constructive modification. If the T antenna enters the loop first while the R antenna is still outside and receiving a strong but backward (out of phase) signal, the T antenna may accordingly transmit a destructive signal which "locks up" the detector circuitry. The knowledge that this relationships exists, and the specific design of the device to take these matters into account are important aspects of the invention.

It is important under this invention to ensure that only signals of the proper phase are permitted to be transmitted. The horizontal positioning of the T and R as mentioned above, represents one method for insuring proper phasing. Other exemplary methods to ensure proper operational orientation and include the use of concentric T/R antennas (e.g. in a co-planar arrangement therebetween) or the use of three front-to-back antennas R/T/R (e.g tandemly arranged) such that only when both R antennas are inside the loop (e.g. tandemly inside) would their signals add (in phase) to produce a T signal.

In the tandem R/T/R arrangement, if one R is outside and the other R is inside, then their derived signals would be of opposite phase, thus cancelling and producing a zero signal at T.

In the concentric T/R arrangement, proper phasing for use on a motorcycle may include a concentric arrangement of antennas of different sizes, preferably at different height placements or elevational positioning such as the placement of the receiving antenna underneath the motorcycle and the transmitting antenna along a peripheral zone of a motorcycle seat (such as externally or internally around its periphery or within the outer perimeter margin thereof) in a non-regenerative arrangement.

The receiving antenna R (or R antennas) intercept an electrical signal from the field which electrical signal is then transformed by the simulator 10 into an amplified signal which substantially simulates the activation effects caused by a normally detectable vehicle. The circuitry of the simulator of the present invention (shown and described in detail with reference to FIG. 3) constitutes essentially a means for transferring signals from the receiving antenna 16 (or R) to the transmitting antenna 20 (or T) at an appropriate amplitude and in the necessary relative phase.

More particularly, the radio-frequency energy impressed upon the field of the roadway sensor loop 24 by the transmitting antenna 20 should be in substantial phase opposition thereto. That is to say, the r-f signal derived from the field of roadway loop 24 by receiving antenna 16 is transformed by the circuitry into a signal of substantially opposite phase at the transmitting antenna 20.

Figure 3:
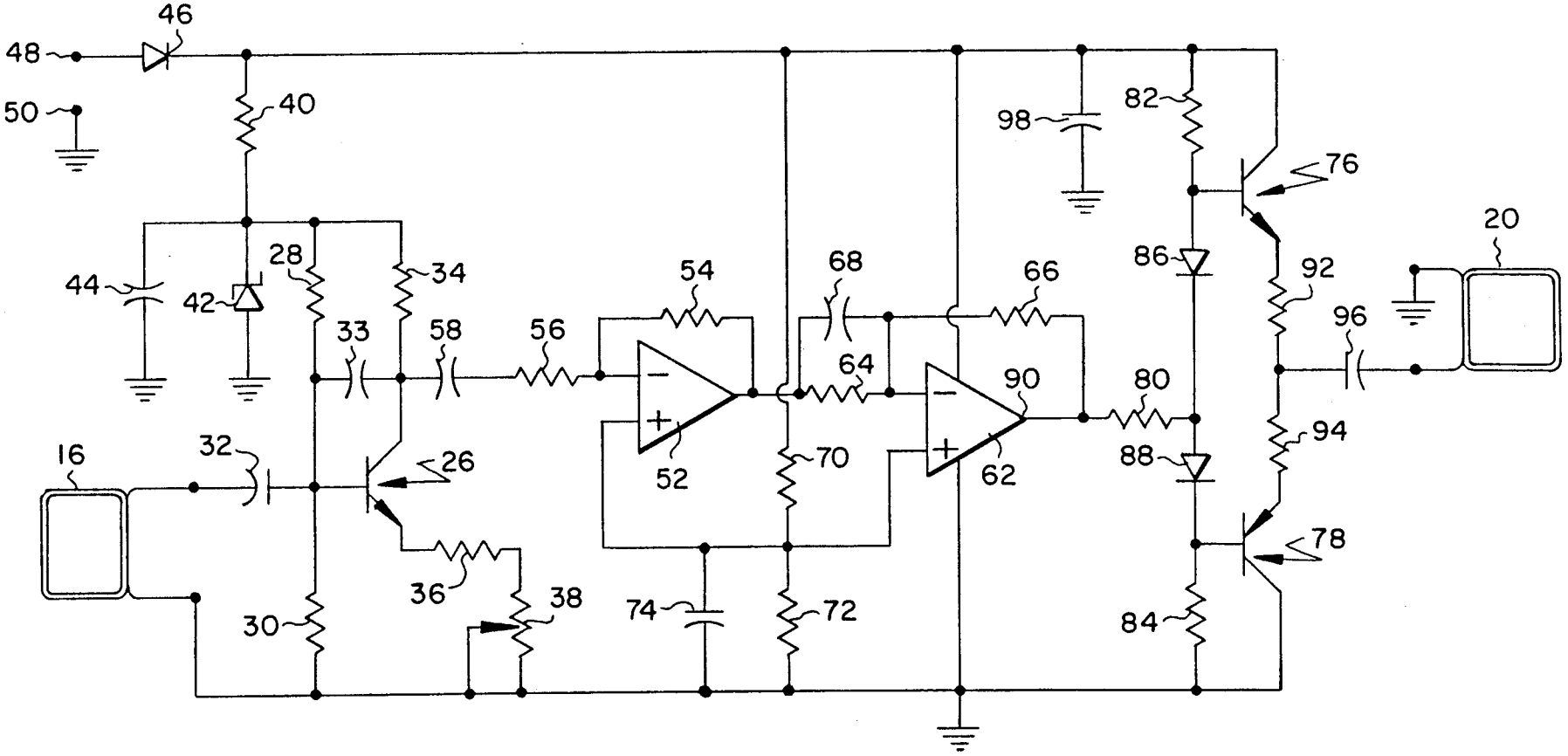
FIG. 3 is a schematic drawing of one preferred form of the circuitry of the simulator of the present invention.
Figure 4:
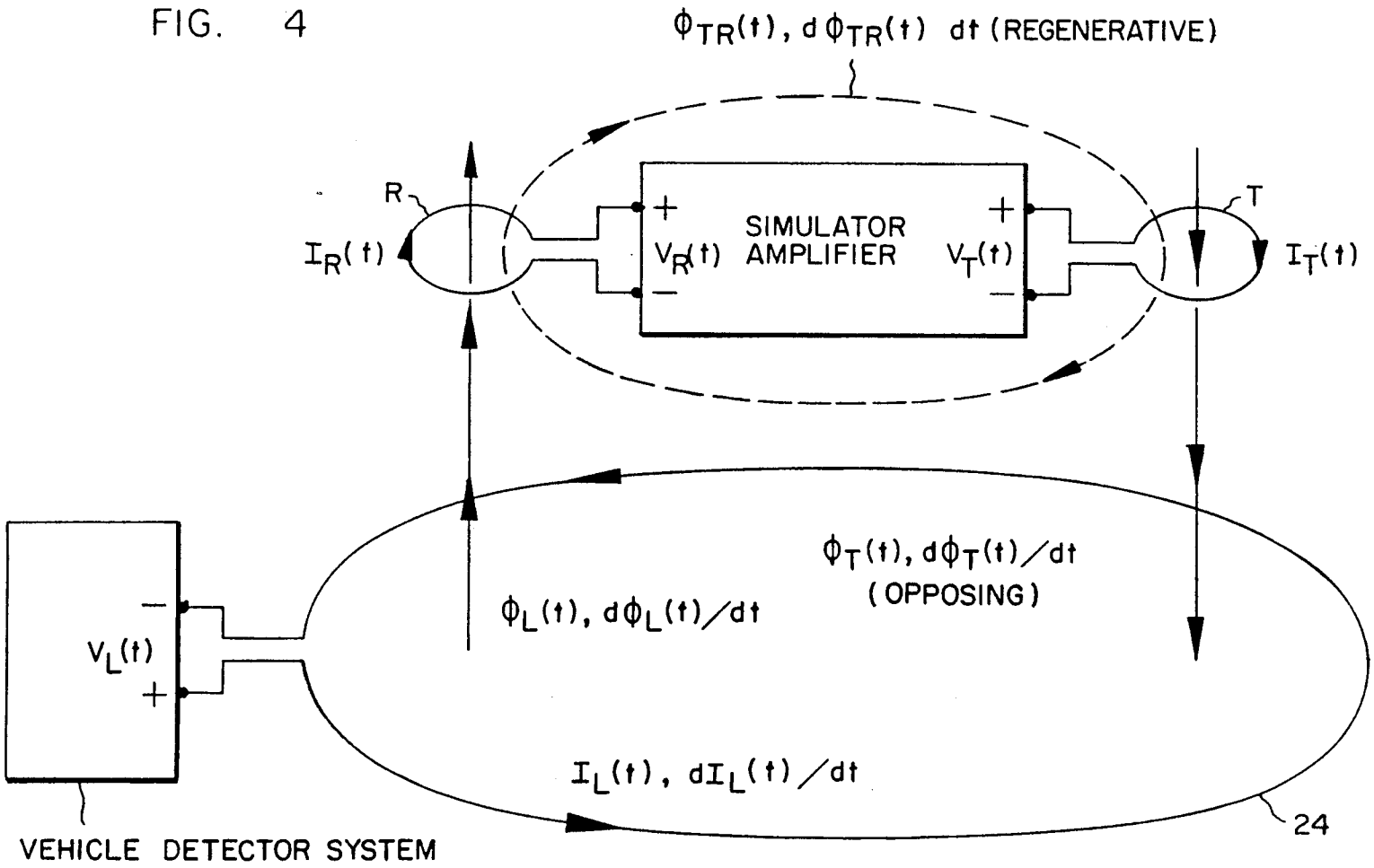
FIG. 4 depicts the cooperative interrelationship between the electromagnetic fields of a vehicular detector system and the detectable vehicular simulator of this invention.

Further, the r-f signal which may be gleaned from the inductive field of roadway loop 24 is quite small, and even with a placement of the simulator unit 10 on the vehicle at a position which is optimal with respect to enhancing the interception of the r-f energy by the receiving antenna 16, the output of such antenna available to the circuit of FIG. 3 may be as little as 5 to 10 millivolts. Accordingly, it is incumbent upon the design of this circuitry to provide the necessary amplification (and phase management) in as an expedient manner as possible in connection with miniaturization and cost effectiveness, and it is with these considerations in mind that the circuitry of FIG. 3 is designed. The system may be regenerative (but need not be) because the signal from the T antenna (in cases other than concentric mounting) will be seen by the R antenna in the same polarity as the signal coming from the roadway; this is illustrated in FIG. 4 by the dotted line linking R and T and designated as "regenerative".

It should also be noted that at frequencies around 50 kilohertz, the wavelength is very long (6 thousand meters) so that the magnetic field coupling the two loops will not change phase, but will change amplitude in direct proportion to the distance between centers of the T/R loops. Experiments have been conducted so as to shield R from T and in many cases a non-regenerative arrangement is preferred, but difficult to achieve. Conceptually, regeneration is not fundamental to this invention.

Turning more specifically to the details of the of FIG. 3 circuit, the receiving antenna 16 intercepts the r-f inductive field of the roadway sensing loop 24, and applies an input signal to the first stage or preamplifier comprising, in the main, transistor 26, the d-c bias for the base of which is provided by a voltage divider formed by resistors 28 and 30, with capacitor 32 providing a-c signal coupling between the antenna 16 and transistor 26.

Resistors 34 and 36 and potentiometer 38 bias the output circuit and provide gain control for the preamplifier stage, and capacitor 33 provides a stabilizing feedback to prevent high frequency oscillation. Resistor 40, Zener diode 42 and capacitor 44 afford voltage regulation to provide a voltage independent of that of the vehicle battery, which, while nominally 12 volts, can vary from 11 to 14 volts. Diode 46 connects the circuit to the vehicle battery at power terminals 48 and 50, to prevent damage if a reversal of power connections occurs during installation.

An amplifier and phase-shift circuit includes operational amplifier 52. Resistors 54 and 56 and capacitor 58 establish the gain of this stage and capacitor 58 provides an essential 90 degree phase shift so that the ultimate phase relationship of $\phi_T = -\phi_L$ will exist wherein $\phi_T$ represents the magnetic flux created by the transmitting antenna 20, and ,$\phi_L$ represents the magnetic flux which is caused by the loop 24 which is buried in the road surface. More importantly, the negative sign (−), indicates that the flux $\phi_T$ opposes the flux $\phi_L$ and thus acts to cancel it.

An output driver stage is comprised of operational amplifier 62 whose gain is determined by resistor 64 and 66 and capacitor 68. Capacitor 68 is a frequency compensation component of a small value, and does not cause a 90 degree phase shift as capacitor 58.

Resistors 70 and 72 and capacitor 74 provides a reference voltage for both stages 52 and 62, and in this connection it will be found convenient to design these two stages as a single integrated circuit. Generally the reference voltage will be established at one-half the value of the battery voltage so that the maximum amplitude AC signal can exist in the operational amplifier circuitry.

As a current buffer output stage, transistors 76 and 78 are connected in emitter-follower fashion, and a bias network comprising resistors 80, 82 and 84 and diodes 86 and 88 keeps the output centered at substantially half the supply voltage in the absence of a signal output at pin 90 of stage 62.

Resistors 92 and 94 constitute small impedances in the output circuit to decouple the source-driver and the sink-driver to preclude any shorting of the power supply which might occur upon simultaneous operation of the transistors 76 and 78.

Capacitor 96 constitutes the output a-c signal coupling to the transmitting antenna 20, staying charged to substantially half the supply voltage so that the voltage at the transmitting antenna 20 is zero when the output of the circuit is at the quiescent level of half such supply voltage, as opposed to the excessive current that would otherwise occur in view of the low resistance of antenna 20.

Capacitor 98 serves with diode 46 as a filter for the battery supply voltage; the diode precludes damage which would occur upon a reverse connection of the battery leads, and the capacitor stabilizes the voltage.

Both the receiving and the transmitting antennas 16 and 20 comprise open loops or coils and preferably are square in configuration in order to optimize the area enclosed thereby. Other antenna shapes are also acceptable, and the T and R antennae are neither required to have the same shape nor the same size.

In the operation of the simulator 10 of the present invention, receiving antenna 16 intercepts the r-f field of roadway sensor loop 24 and derives an electrical signal therefrom, applying such signal to the amplifying and phase-shifting circuitry of FIG. 3 described in detail above, whereby a signal representative of such derived and amplified signal appears in the transmitting antenna 20. The antenna creates an r-f field which is in phase opposition with the original field emanating from the roadway loop 24. The interaction of the two opposing field causes a predetermined change in the original field (usually a small frequency shift in one embodiment downward) which is detected by the traffic vehicle detector and control system. The predetermined change substantially duplicates that change which would occur if a vehicle of detectable size or magnitude were to enter the same detector loop 24; thus the vehicle detector system reacts in a normal traffic control manner, provided that this change is at least as great as the design minimum for the detector circuitry associated with the roadway sensing loop 24.

As is well known to those skilled in this art, the change which occurs in the r-f field of a roadway sensing loop is a decrease in the frequency thereof, due to the presence, on the one hand, of an increased inductance caused by the magnetic materials of a sensed vehicle, and the increased loading of the field, on the other hand, resulting from eddy currents and their opposing magnetic fields induced in the electrically conductive mass of the vehicle by the r-f field. Eddy currents are small loops of circulating current within a conductive mass each of which absorbs some of the field energy and causes an opposing magnetic field. Cumulatively, the effect of an infinite number of eddy loops can be quite significant. It is noted that depending on the detector circuitry, the change of inductance or eddy current effects may produce a frequency shift in either direction depending entirely on the specific circuitry of the loop detector system. Usually the greater the metallic presence, whether magnetic or merely conductive, the greater will be the shift of the frequency of operation in the roadway sensing loop, since this loop is part of a resonant oscillator circuit in the loop detector. Typically, in vehicle detector loop systems, the roadway loop is one component of some type of oscillator circuit. The change of inductance and influence of the opposing eddy current field cause the oscillator circuit to shift in frequency (and/or amplitude) by a small amount, which is interpreted as an indication of the presence of a vehicle within the loop. The nature of the shift which is sensed by the detector system depends upon its particular circuit configuration, but since all are designed to detect a vehicle, the method of this invention (which is to simulate the electromagnetic influence of a vehicle) works universally with such loop detector systems.

Regardless of the type of amplifier and antenna system utilized in the simulator device of the invention, the principle remains the same and can be defined as shown in FIG. 4 wherein the designated field vectors, voltages, and currents are as follows:

$\phi(t)$ is any magnetic flux field at a particular instant of time, $\phi_L(t)$ of the loop, $\phi_T(t)$ of the transmitter antenna, $d\phi(t)/dt$ is the time varying derivative or rate of change of any flux field, $I_R(t)$, $V_R(t)$ are the current and voltage induced in the receiving antenna coil, $I_T(t)$ is the current drive to the transmitting antenna, and $\phi_{TR}(t)$ represents a small but "regenerative" field coupling the transmitting and receiving antennas.

In the preferred embodiments of this invention, it is practical to think of the amplifier as an AC coupled voltage-to-current converter. This, however, is not the only configuration which will produce the desired results since the desired phase shift requirements depend upon the particular circuit approach.

If, as in the preferred embodiment, a high-input-impedance circuit is employed, then the voltage $V_R$ is a function of the rate of change of flux: $V_R(t) = -N_R d\phi_L(t)/dt$. Thus, for sinusoidal oscillations the input is phase shifted 90 degrees relative to $\phi_L(t)$. Since the output must be in phase with (but opposing) $\phi_L(t)$ an additional shift of 90 degrees must be added to complete a 180 degree shift. If a low-input-impedance circuit were used, the circuit would become a current-to-current converter. In this mode, $I_R(t) = k\phi(t)$ and the amplifier responds directly to the flux level, $\phi(t)$, as opposed to the phase-shifted $d\phi(t)/dt$; thus, the added 90 degree shift would not be utilized.

The simulator of this invention may be effectively used in conjunction with a wide variety of vehicular conveyances (motorized or unmotorized) which are unsusceptible to detection by conventional traffic control systems. As mentioned before, such undetectability can arise when the electromagnetic influence of an undetectable conveyance fails to intercept the field of detection (e.g. high-wheeled vehicles such as semi-trailers which due to intersectional turning maneuvers and/or elevated mass or distribution, etc.) or under circumstances involving a vehicle of insufficient electromagnetic mass for detection by the system such as small cars, motorcycles, vehicles heavily fabricated with non-electromagnetic materials (e.g. plastics), etc.

As previously mentioned, normally undetectable vehicles or conveyances become detectable by appropriately mounting the simulator onto such undetectable vehicles or conveyances so as to operationally interact with the signal system. The simulator may be provided as an accessory unit for installation onto an undetectable vehicle or conveyance, or may be directly fabricated as an integral part of the vehicle or conveyance in its manufacture. The simulator 10 when provided as an "add-on" accessory unit will preferably include means for mounting the simulator 10 at an operational position so as to derive (e.g. intercept) the electrical signal from the field and to impress an activating amplified simulating signal onto the field. The means for mounting the simulator (as a single unit 10 as shown in FIG. 1 or as separately mountable component parts such as R and T and/or circuit module 22 at different mounting sites) should take into account proper orientation between the receiving antenna or antennas R and transmitting antenna T to ensure that proper electrical phase and gain will be maintained after its installation.

The simulator in simulating the activating effects produced by a detectable vehicle or conveyance may augment or supplement the electromagnetic influence of the undetectable vehicle or conveyance (albeit insufficient for activation by itself) so that the cumulative influence thereof (e.g. undetectable vehicle influence plus impressed signal) serves to create the necessary predetermined changes in simulating those effects produced by a detectable vehicle or conveyance.

The present invention has been described herein in considerable detail in connection with one preferred embodiment thereof, and with particular reference to specific circuitry for accomplishing the result intended. However, it will be obvious to those skilled in the art that the invention concept herein may be fulfilled with circuitry and physical design of modified characteristics, and hence, the invention should not be considered as being limited to the details given in describing such preferred embodiment, but only as defined by the appended claims.

What is claimed:

1. For use in conjunction with a traffic signal control system for selectively governing the operation of an associated traffic signal of the type having an A.C. energized sensing loop buried in or otherwise positioned relative to a roadway so as to detect predetermined changes in the characteristics of its electromagnetic field due to activation thereof by a detectable vehicle, a simulator for inducing said predetermined changes upon said system when transported aboard an otherwise undetectable vehicle, said simulator comprising:

a) means for deriving an electrical signal from said field, b) means for amplifying said electrical signal, c) means for impressing upon said field a representation of said amplified signal, whereby the activation by said simulator aboard said undetectable vehicle serves to modify the characteristics of said field in a manner substantially simulating that produced by a detectable vehicle.

2. The simulator of claim 1, wherein said means for deriving an electrical signal from said field comprises a receiving antenna.

3. The simulator of claim 2, wherein said receiving antenna comprises a first mobile loop antenna.

4. The simulator of claim 1, wherein said means for impressing upon said field a representation of said amplified signal comprises a transmitting antenna.

5. The simulator of claim 4, wherein said transmitting antenna comprises a second mobile loop antenna.

6. The simulator of claim 1, wherein said means for deriving said electrical signal from said field comprises a receiving antenna, and said means for impressing upon said field a representation of said amplified signal comprises a transmitting antenna.

7. The simulator of claim 6 wherein the simulator includes an arrangement so that:

a) a line intersecting the centers of the receiving antenna and the transmitting antenna is substantially perpendicular to the line defining the direction of travel of said otherwise undetectable vehicle so as to allow said receiving antenna and said transmitting antenna to substantially enter at the same time said sensing loop of said roadway, and b) the planes of said receiving antenna and said transmitting antenna are substantially parallel to said roadway and said planes are substantially co-planar.

8. The simulator according to claim 7 wherein the receiving antenna, the means for amplifying the electrical signal and the transmitting antenna are housed within a unitary housing member at a fixed position for receiving and transmitting an activating signal.

9. The simulator of claim 8 wherein the housing member includes means for mounting the simulator onto the undetectable vehicle at a position so as to operationally derive the electrical signal from said field and to impress an amplified signal substantially replicating that of a detectable vehicle onto said field when the mounted simulator intercepts said field.

10. The simulator of claim 9 wherein the housing member is of a size and configuration for mounting onto a motorcycle.

11. The simulator of claim 6 wherein the receiving antenna and the transmitting antenna are respectively of a size and configuration so as to create a concentric relationship therebetween.

12. The simulator of claim 11 wherein the simulator includes means for positioning said receiving antenna and said transmitting antenna in a substantially co-planar relationship.

13. The simulator of claim 11 wherein the simulator includes means for positioning the receiving antenna and the transmitting antenna so as to intercept the field at different elevations.

14. The simulator of claim 13 fitted with means for mounting said simulator to a motorcycle, the transmitting antenna includes means for the mounting the transmitting antenna at a peripheral zone of a motorcycle seat and the receiving antenna includes means for the mounting upon said motorcycle at a lower elevation than said transmitting antenna.

15. The simulator of claim 1 wherein the simulator includes at least two receiving antenna as a means for deriving an electrical signal from said field and at least one transmitting antenna as the means for impressing said amplified signal upon said sensing loop.

16. The simulator of claim 15 wherein the simulator a) means for mounting the simulator onto an undetectable vehicle at an intercepting position in relationship to said field;

b) a first receiving antenna and a second receiving antenna tandemly aligned substantially parallel to the direction of travel of the undetectable vehicle so as to thereby tandemly intercept and derive an electrical signal from said field; and c) means for impressing upon said field an amplified signal substantially simulating that which is produced by a detectable vehicle upon the presence of said first antenna and said second antenna within said field.

17. The simulator of claim 1 wherein the means for impressing upon said field includes at least one transmitting antenna and the means for deriving an electrical signal from said field comprises at least one receiving antenna with said receiving antenna and said transmitting antenna being respectively positionally oriented in such a manner so as to produce a transmittable signal for impressing upon said field by said transmitting antenna.

18. The simulator of claim 17 wherein the simulator includes:

a) means for mounting the simulator onto an undetectable vehicle at an intercepting position in relationship to the field;

b) a plurality of receiving antennas including a first receiving antenna and a second receiving antenna positionally arranged within said simulator so as to mutually derive an electrical signal from said field upon the intercepting positioning of said first antenna and said second antenna within said field; and c) the transmitting antenna is activated to transmit a signal substantially replicating that produced by a detectable vehicle upon the mutual intercepting of said first antenna and said second antenna onto said field.

19. The simulator of claim 1 wherein the simulator includes means for modifying the electrical signal into a transmittable signal which when impressed upon said field substantially simulates an activating effect as produced by a detectable vehicle.

20. The simulator of claim 19 wherein said simulator also includes electrical phase shifting circuitry such that the simulator produces an amplified signal for impression upon said field substantially 180 degrees out of phase from the electrical signal derived from said field.

21. The simulator of claim 19, wherein the amplified signal simulates the effect of a change in inductance of the buried sensing loop.

22. The simulator of claim 21 wherein the simulated inductance change causes a frequency shift which frequency shift is detectable by the system.

23. The simulator of claim 1 wherein said means for impressing upon said field a representation of said amplified signal also impresses upon said deriving means a representation of said amplified signal affecting a feedback.

24. The simulator of claim 1, wherein said simulator is adapted for assemblage into a vehicle having an insufficient metallic mass to be detected by said system and is fabricated into said vehicle as an integral part thereof.

25. The simulator of claim 1 wherein the simulator is adapted for assemblage onto a vehicular conveyance having a metallic mass which is undetectable by said system due to the elevational relationship of said metallic mass to said field.

26. The simulator of claim 19 wherein the means for impressing upon said field comprises means for impressing a transmitted signal upon said field and the simulator in combination with the undetectable vehicle augments said predetermined changes upon said system sufficiently to cause activation thereof.

27. The simulator of claim 26 wherein the means for modifying the electrical signal includes a filtering and a reshaping of the electrical signal into a transmittable wave form which when impressed as the transmitted signal upon said field simulates the presence of a detectable vehicle within said field.

28. The simulator of claim 19 wherein the transmittable signal causes a frequency shift detectable by the system.

* * * * *